US008967963B2

(12) United States Patent
Chen

(10) Patent No.: US 8,967,963 B2
(45) Date of Patent: Mar. 3, 2015

(54) FAN MODULE

(75) Inventor: Chih-Hua Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 559 days.

(21) Appl. No.: 13/283,589

(22) Filed: Oct. 28, 2011

(65) Prior Publication Data

US 2013/0028709 A1 Jan. 31, 2013

(30) Foreign Application Priority Data

Jul. 25, 2011 (TW) ..... 100126258 A

(51) Int. Cl.

| | |
|---|---|
| ***F01D 25/28*** | (2006.01) |
| ***F04D 19/00*** | (2006.01) |
| ***F04D 29/60*** | (2006.01) |
| ***F04D 29/66*** | (2006.01) |

(52) U.S. Cl.

CPC ..... *F04D 19/007* (2013.01); *F04D 29/601* (2013.01); *F04D 29/668* (2013.01)

USPC ..... 415/213.1; 416/244 R

(58) Field of Classification Search

CPC ..... F04D 29/329; F04D 29/60; F04D 29/66; F04D 29/601; F04D 29/602; F04D 29/668; F05D 2260/964

USPC ..... 415/119, 213.1, 214.1; 416/244 R

See application file for complete search history.

(56) References Cited

U.S. PATENT DOCUMENTS

| | | | | |
|---|---|---|---|---|
| 5,186,605 | A * | 2/1993 | Tracy | 415/119 |
| 6,556,437 | B1 * | 4/2003 | Hardin | 361/679.48 |
| 7,697,287 | B2 * | 4/2010 | Yin | 361/695 |
| 7,862,297 | B2 * | 1/2011 | Mizuguchi | 415/213.1 |

FOREIGN PATENT DOCUMENTS

| | | | | |
|---|---|---|---|---|
| WO | WO 2011009784 A2 * | 1/2011 | ..... | F25D 17/06 |

* cited by examiner

*Primary Examiner* — Dwayne J White
*Assistant Examiner* — Jason Fountain
(74) *Attorney, Agent, or Firm* — Novak Druce Connolly Bove + Quigg LLP

(57) ABSTRACT

A fan module includes a cooling fan, a supporting rack, and a number of fasteners sandwiched between the cooling fan and the supporting rack. The fasteners are made of vibration-resistant material. The supporting rack includes two opposite supporting walls. An installing portion protrudes out from a top of each supporting plate. Each fastener is sandwiched between the cooling fan and the corresponding installing portion. An extension portion extends from each fastener to resist against an outside surface of the cooling fan.

8 Claims, 4 Drawing Sheets

FAN MODULE

BACKGROUND

1. Technical Field

The present disclosure relates to a fan module.

2. Description of Related Art

Typically, a cooling fan is needed for a computer, and is mounted on a computer enclosure through screws, which is inconvenient. During operation, the cooling fan may generate undesirable vibration, with resulting in vibration noise. Such vibration can adversely affect other components in the enclosure.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, like reference numerals designate corresponding parts throughout the several views.

DETAILED DESCRIPTION

The present disclosure, including the accompanying drawings, is illustrated by way of examples and not by way of limitation. It should be noted that references to "an" or "one" embodiment in this disclosure are not necessarily to the same embodiment, and such references mean at least one.

Figure 1:
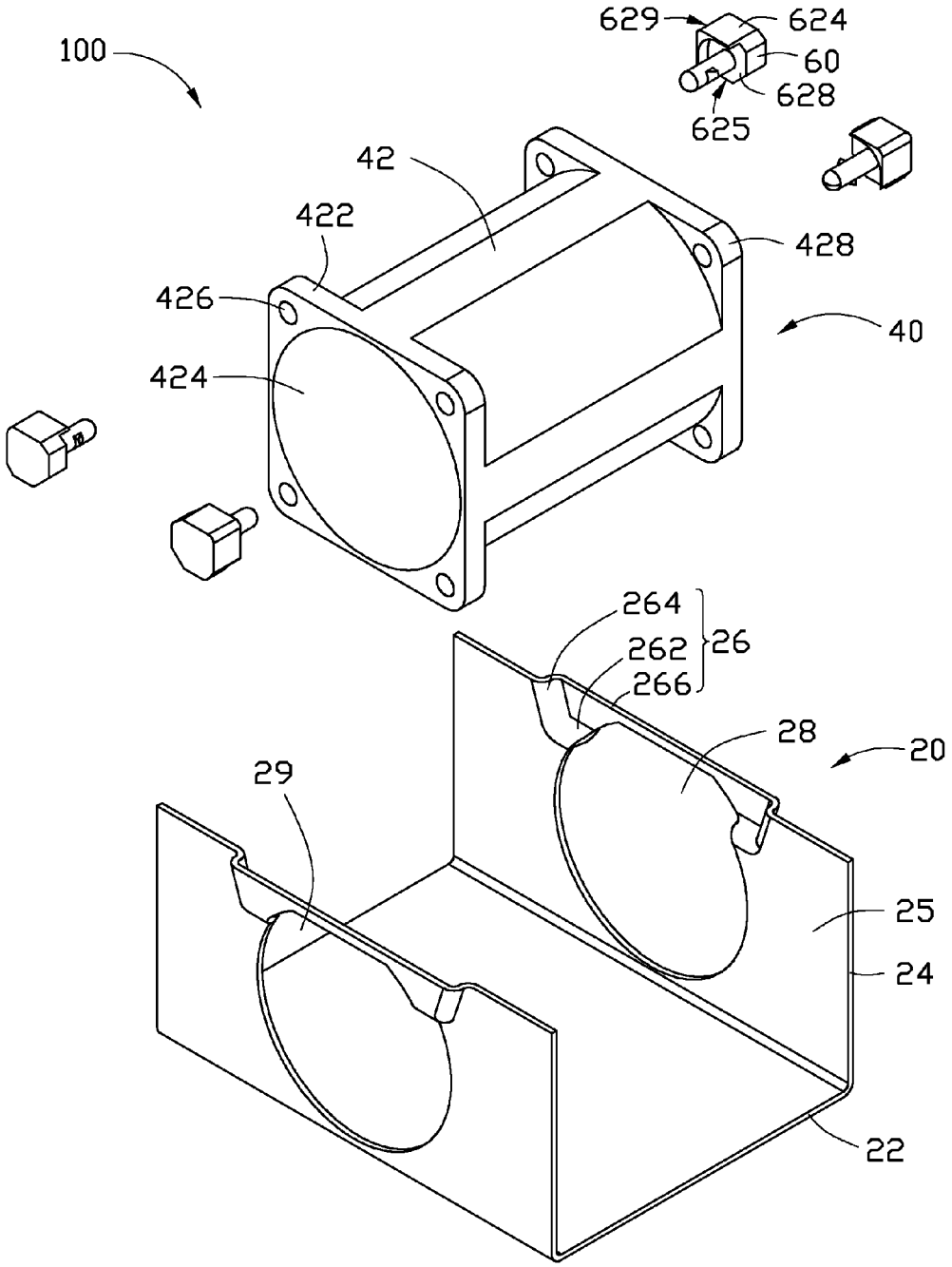
FIG. 1 is an exploded, isometric view of an exemplary embodiment of a fan module, wherein the fan module includes four fasteners.

Referring to FIG. 1, an exemplary embodiment of a fan module 100 includes a supporting rack 20, a cooling fan 40, and four fasteners 60 for fixing the cooling fan 40 to the supporting rack 20.

The supporting rack 20 is substantially U-shaped and integrally bent from a single metal plate. The supporting rack 20 includes a rectangular base 22 and two supporting walls 24 perpendicularly extending up from opposite sides of the base 22, respectively. Two opposite installing portions 26 are respectively protruding out from the supporting walls 24, away from each other. The base 22 and the supporting walls 24 cooperatively bound a receiving space 25.

Each supporting wall 24 is rectangular. One of the supporting walls 24 defines a round air inlet 29, and the other supporting wall 24 defines a round air outlet 28 aligning with the air inlet 29. The installing portion 26 is substantially U-shaped and extends out from an upper portion of each supporting wall 24. The installing portion 26 includes two supporting plates 262 extending out from the supporting wall 24 at opposite sides of an upper portion of the air inlet 29 or the air outlet 28, two guiding plates 264 slantingly extending up and out from the ends of the supporting plates 262 opposite to the air inlet 29 or the air outlet 28 and connected to the supporting wall 24, and an abutting plate 266 connected between outer sides of the guiding plates 264 and connected to the supporting plates 262. The abutting plate 266 is parallel to the supporting wall 24.

The cooling fan 40 includes a hollow frame 42 and an impeller (not shown) mounted in the frame 42. The frame 42 defines a cylindrical receiving hole 424 for receiving the impeller. The frame 42 includes two opposite rectangular sidewalls 422, with four mounting holes 426 defined in four corners of each of the sidewalls 422. The receiving hole 424 extends through the sidewalls 422. Four arc-shaped connecting portions 428 are formed at four corners of each of the sidewalls 422, each connecting portion 428 connected between two adjacent sides of the sidewall 422.

Figure 2:
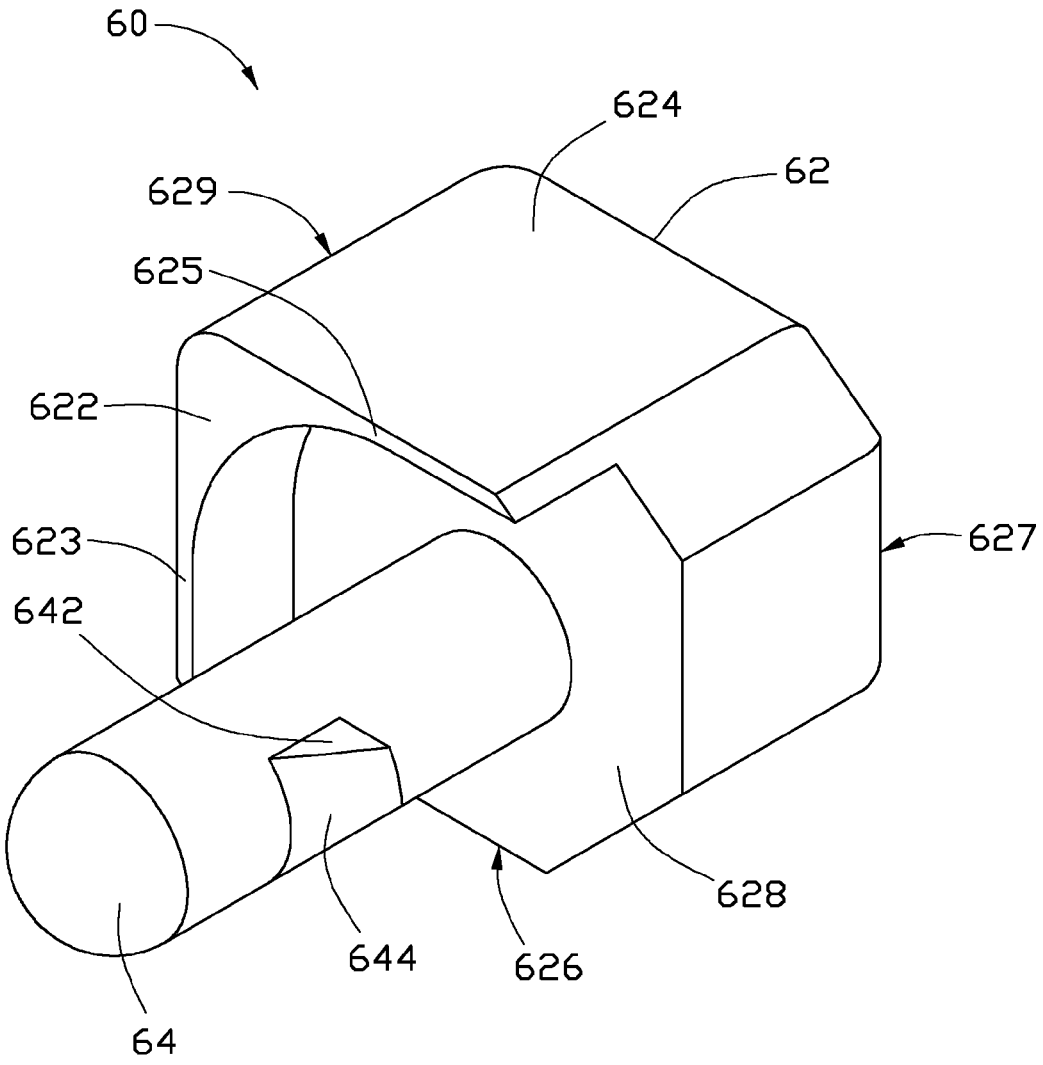
FIG. 2 is an enlarged, isometric view of one of the fasteners of FIG. 1

Referring to FIG. 2, the fasteners 60 are made with vibration-resistant material, such as rubber or foam. Each of the fasteners 60 includes a substantially rectangular main body 62, and a cylindrical latching pin 64 perpendicularly extending out from a surface of the main body 62. The main body includes a top surface 624, a bottom surface 626 opposite to the top surface 624, a first end surface 627 perpendicularly connected between the top surface 624 and the bottom surface 626, a second end surface 628 perpendicularly connected between the top surface 624 and the bottom surface 626 and opposite to the first end surface 627, and a side surface 629 perpendicularly connected among the first end surface 627, the second end surface 628, the top surface 624, and the bottom surface 626. The latching pin 64 perpendicularly extends from a center of the second end surface 628.

An L-shaped extending portion 622 protrudes out from two adjacent sides of the second end surface 628, adjacent to the top surface 624 and the side surface 629. The extending portion 622 includes a first engaging plate 623 extending along the side surface 629, and a second engaging plate 625 extending along the top surface 624. A substantially wedge-shaped resilient latching block 642 protrudes from a middle of a circumference of the latching pin 64, opposite to a junction of the first and second engaging plates 623 and 625. A slanted guiding surface 644 is formed in an outer surface of the latching block 642, opposite to the latching pin 64.

Figure 3:
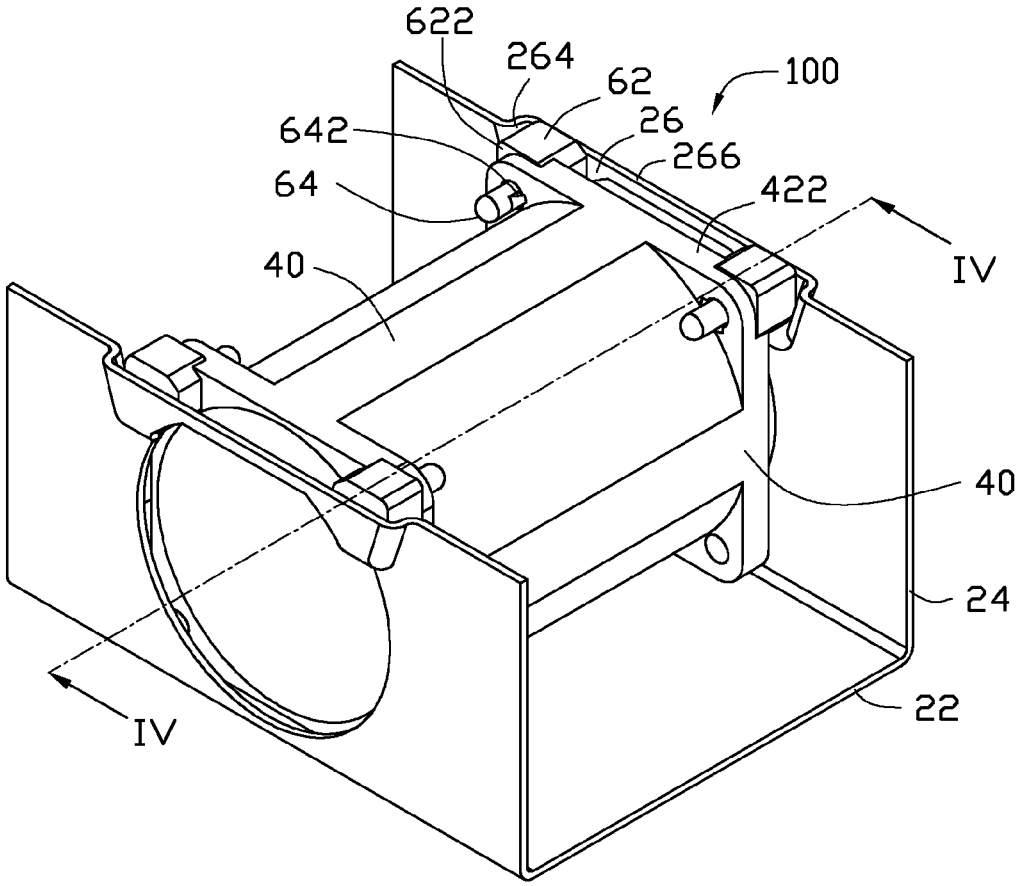
FIG. 3 is an assembled, isometric view of the fan module of FIG. 1.
Figure 4:
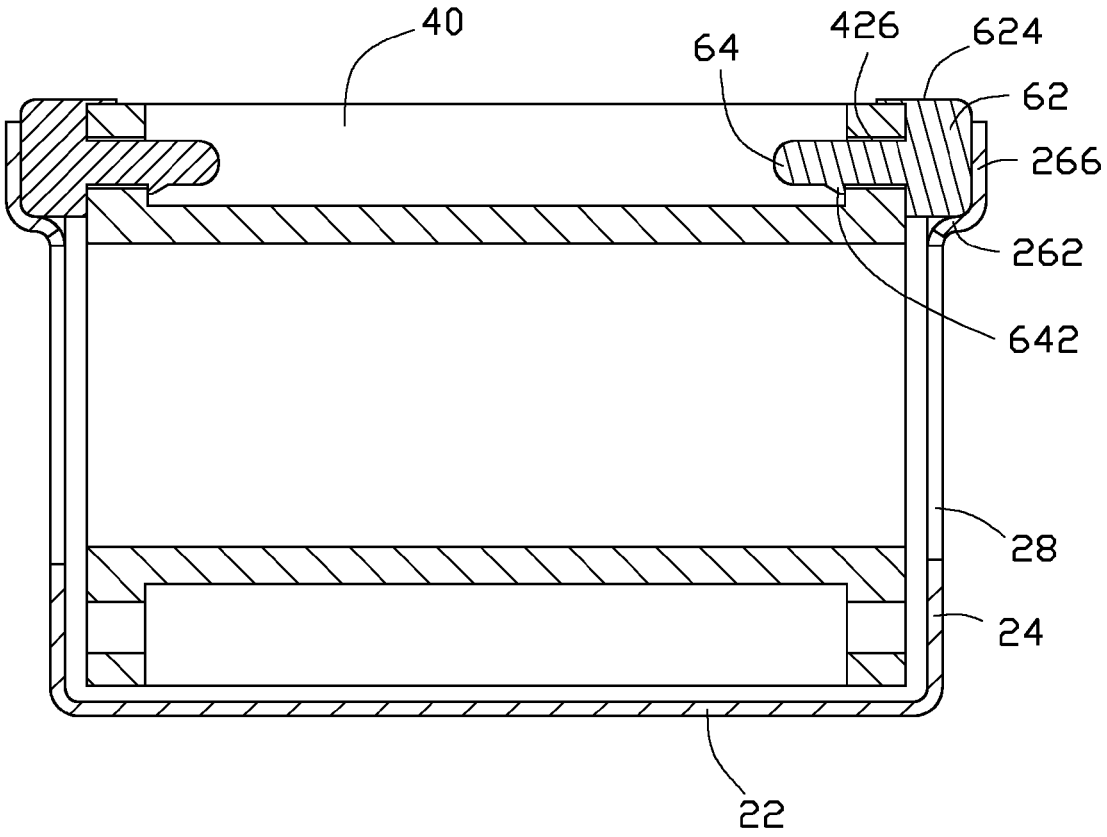
FIG. 4 is a cross-sectional view of FIG. 3, taken along the line of IV-IV.

Referring to FIGS. 3 and 4, in assembly, the latching pin 64 of each fastener 60 is inserted into the corresponding mounting hole 426 of an upper portion of the cooling fan 40, from an outside surface of the corresponding sidewall 422. The guiding surface 644 of the latching block 642 slidably abuts against a sidewall bounding the mounting hole 426, to deform the latching block 642, until the latching block 642 passes through the mounting hole 426. The latching block 642 is restored to be blocked by an inside of the sidewall 422. The second end surface 628 of the fastener 60 abuts against the outside surface of the sidewall 422. The extending portion 622 abuts against the corresponding sides of the sidewall 422. Therefore, the fastener 60 is securely latched to the cooling fan 40.

The cooling fan 40 is inserted into the receiving space 25 of the supporting rack 20. The two fasteners 60 at each sidewall 422 are received in opposite ends of the corresponding installing portion 26. The cooling fan 40 is pressed down. Each fastener 60 moves down and is deformed by the abutting plate 266, until the bottom surface 626 of each fastener 60 is supported on the supporting plates 262. The first end surface 627 of each fastener 60 abuts against the abutting plate 266. The side surface 629 of each fastener 60 abuts against the corresponding guiding plate 264. Therefore, the cooling fan 40 is securely engaged in the supporting rack 20. The receiving hole 424 aligns with the air inlet 29 and the air outlet 28.

The top surface 624 of each fastener 60 is protruded out of a top surface of the corresponding supporting wall 24, for avoiding interference between the cooling fan 40 and other elements, such as motherboard or hard disk drives. A U-shaped space is formed between each supporting wall 24 of the supporting rack 20 and the corresponding sidewall 422 and the base 22 of the cooling fan 40, through the fasteners 60.

In disassembly, the cooling fan 40 is pulled out from the supporting rack 20. The fasteners 60 are disengaged from the installing portions 26. Therefore, the cooling fan 40 may be easily separated from the supporting rack 20.

During operation, the fasteners 60 can absorb the energy of vibrations generated by the cooling fan 40.

It is to be understood, however, that even though numerous characteristics and advantages of the embodiments have been set forth in the foregoing description, together with details of the structure and function of the embodiments, the present disclosure is illustrative only, and changes may be made in details, especially in the matters of shape, size, and arrangement of parts within the principles of the embodiments to the full extent indicated by the broad general meaning of the terms in which the appended claims are expressed.

What is claimed is:

1. A fan module comprising:

a cooling fan;

a supporting rack comprising two opposite supporting walls between which the cooling fan is accommodated, an installing portion protruding out from an upper portion of each supporting wall; and a plurality of fasteners made of vibration-resistant material, and sandwiched between the cooling fan and the installing portions, an extending portion extending from each fastener and resisting against an outside surface of the cooling fan;

wherein one of the supporting walls defines an air inlet, and the other supporting wall defines an air outlet aligning with the air inlet, each installing portion comprises two supporting plates extending out from the supporting wall at opposite sides of an upper portion of the air inlet or the air outlet, two guiding plates slantingly extending up from ends of the supporting plates, and an abutting plate connected between outer sides of the guiding plates.

2. The fan module of claim 1, wherein each fastener comprises a main body, the main body comprises a first end surface abutting against the installing portion, and a second end surface opposite to the first end surface and abutting against the cooling fan, the extending portion extends out from the second end surface.

3. The fan module of claim 2, wherein the cooling fan comprises two opposite rectangular sidewalls, two of the fasteners are mounted to two upper corners of each sidewall, the extending portion of each fastener resists against a top and a side connected to the top of the corresponding sidewall.

4. The fan module of claim 3, wherein each fastener further comprises a latching pin extending out from a center of the second end surface of the main body, each corner of each sidewall defines a mounting hole for the latching pin of a corresponding one of the fasteners extending through.

5. The fan module of claim 4, wherein a resilient latching block protrudes from a circumference of each latching pin opposite to the extending portion, the latching block passes through the corresponding mounting hole to be blocked by an inside surface of a corresponding sidewall facing the other sidewall.

6. The fan module of claim 5, wherein a guiding surface is formed on an outside surface of each latching block.

7. The fan module of claim 2, wherein the supporting rack further comprises a rectangular base, the supporting walls extend up from opposite sides of the base, the base and the supporting walls are cooperatively bound a receiving space, for receiving the cooling fan, a space is formed between the cooling fan and each supporting wall.

8. The fan module of claim 2, wherein the main body further comprises a bottom surface supported on the corresponding supporting plate, a side surface is resiliently engaged with a corresponding one of the guiding plates, and the first end surface is resiliently engaged with the corresponding abutting plate.

* * * * *